US006764145B2

(12) United States Patent
Canedy et al.

(10) Patent No.: US 6,764,145 B2
(45) Date of Patent: Jul. 20, 2004

(54) DISPLAY CASE SECURITY APPARATUS WITH A HINGED CLOSURE ASSEMBLY

(75) Inventors: John F. Canedy, Rowlett, TX (US); Leo Faubion, Plano, TX (US)

(73) Assignee: Faubion Associates, Inc., Dallas, TX (US)

( * ) Notice: Subject to any disclaimer, the term of this patent is extended or adjusted under 35 U.S.C. 154(b) by 0 days.

(21) Appl. No.: 10/456,711

(22) Filed: Jun. 6, 2003

(65) Prior Publication Data

US 2003/0193275 A1 Oct. 16, 2003

Related U.S. Application Data

(63) Continuation of application No. 10/369,332, filed on Feb. 18, 2003, which is a continuation of application No. 09/997,401, filed on Nov. 29, 2001, now Pat. No. 6,540,311.

(60) Provisional application No. 60/250,038, filed on Nov. 29, 2000.

(51) Int. Cl.[7] ..... A47F 3/00

(52) U.S. Cl. ..... 312/114; 312/312

(58) Field of Search ..... 312/114, 117, 312/138.1, 294, 304, 306, 312, 319.5, 350, 293.2; 109/45, 47

(56) References Cited

U.S. PATENT DOCUMENTS

| | | | |
|---|---|---|---|
| 145,378 | A | 12/1873 | Wilkins |
| 328,475 | A | 10/1885 | Ford |
| 1,441,763 | A | 1/1923 | Stinson |

(List continued on next page.)

FOREIGN PATENT DOCUMENTS

| | | |
|---|---|---|
| DE | 45974 | 1/1911 |
| DE | 2202785 | 8/1973 |
| DE | 3613786 | * 11/1986 |

(List continued on next page.)

*Primary Examiner*—James O. Hansen
(74) *Attorney, Agent, or Firm*—Howison & Arnott, L.L.P.

(57) ABSTRACT

A display case security apparatus comprises a housing, a platform, an elevating mechanism, and a closure assembly. The housing includes a lower storage section and an upper display section disposed above the storage section. The storage section has an opaque exterior wall and the display section has an exterior wall which is at least partially transparent. The platform is disposed within the housing and includes a generally horizontal portion for supporting articles to be displayed. The platform is also configured to define a rearward facing recessed space. The platform is selectively movable between a first position, wherein any articles supported on the platform are displayed in the display section of the housing, and a second position, wherein any articles supported on the platform are stored in the storage section of the housing. The elevating mechanism is mounted within the storage section and connected to the platform. The elevating mechanism is selectively moveable between an extended configuration and a retracted configuration, whereby the platform moves between the first position and the second position when the elevating mechanism moves between the extended configuration and the retracted configuration respectively. The closure assembly is constructed with a first plate joined to a second plate by at least one hinge. The first plate of the closure assembly may be selectively inserted into the recessed space of the platform when the platform is in the first position. Both plates of the closure assembly may be selectively inserted between the display section and the storage section when the platform is in the second position, whereby the platform and any articles supported thereon are enclosed within the storage section of the housing. A method of operation in which the hinged closure assembly is fully withdrawn form the housing, the platform is moved into the raised position, and a portion of the hinged closure is re-inserted into the housing for storage within the recessed space provided in the platform is also disclosed.

16 Claims, 15 Drawing Sheets

U.S. PATENT DOCUMENTS

| | | | | | |
|---|---|---|---|---|---|
| 1,949,954 | A | | 3/1934 | Culler et al. | |
| 1,990,300 | A | | 2/1935 | MIller | |
| 2,201,948 | A | | 5/1940 | Watkins | |
| 2,284,531 | A | | 5/1942 | Miller et al. | |
| 2,569,254 | A | | 9/1951 | Page | |
| 2,687,934 | A | | 8/1954 | Gipple | |
| 3,033,633 | A | * | 5/1962 | Holloway et al. | 312/306 |
| 3,805,962 | A | | 4/1974 | Bendiksen | |
| 4,022,137 | A | | 5/1977 | Chiu | |
| 4,369,717 | A | | 1/1983 | Bollier | |
| 4,942,328 | A | * | 7/1990 | Price | 312/306 |
| 5,129,611 | A | | 7/1992 | Grover et al. | |
| 5,165,768 | A | | 11/1992 | Zarrabi et al. | |
| 5,295,743 | A | | 3/1994 | Moulton et al. | |
| 5,483,905 | A | | 1/1996 | Johansson | |
| 5,524,977 | A | | 6/1996 | Orawski | |
| 5,711,587 | A | * | 1/1998 | Takahashi et al. | 312/265.6 |
| 5,733,021 | A | | 3/1998 | O'Neill et al. | |
| 5,758,936 | A | | 6/1998 | Baughan | |
| 5,791,749 | A | | 8/1998 | O'Neill et al. | |
| 5,820,233 | A | | 10/1998 | Hahn | |
| 5,853,235 | A | | 12/1998 | Barnes | |
| 6,039,414 | A | * | 3/2000 | Melane et al. | 312/205 |
| 6,102,355 | A | | 8/2000 | Rood | |
| 6,540,311 | B2 | | 4/2003 | Canedy et al. | |

FOREIGN PATENT DOCUMENTS

| | | | | |
|---|---|---|---|---|
| EP | 0 521 728 | A1 | | 1/1993 |
| FR | 2619695 | A | | 3/1989 |
| FR | 2712785 | | * | 6/1995 |
| GB | 668942 | | | 3/1952 |
| JP | 52-7700 | | | 1/1977 |
| JP | 408336449 | A | | 12/1996 |

* cited by examiner

DISPLAY CASE SECURITY APPARATUS WITH A HINGED CLOSURE ASSEMBLY

CROSS-REFERENCE TO RELATED APPLICATIONS

This application is a Continuation in Part of U.S. patent application Ser. No. 10/369,332, entitled "DISPLAY CASE SECURITY APPARATUS", filed Feb. 18, 2003, which application is a Continuation of U.S. patent application Ser. No. 09/997,401, entitled "DISPLAY CASE SECURITY APPARATUS", filed Nov. 29, 2001, now issued as U.S. Pat. No. 6,540,311 B2, which application is related to and claims the benefits of priority from U.S. Provisional Patent Application Ser. No. 60/250,038, entitled "DISPLAY CASE SECURITY APPARATUS", filed Nov. 29, 2000.

TECHNICAL FIELD OF THE INVENTION

This invention relates to a display case or cabinet having a moveable platform for supporting valuable articles such as jewelry. In one aspect, it relates to a hinged closure assembly that may be selectively inserted between a display portion and a secure storage portion of the case.

BACKGROUND OF THE INVENTION

Display cases, also known as showcases, are widely used for displaying high-value articles such as jewelry, coins, electronics, cameras, etc. It is readily understood that the typical display case having one or more glass windows is particularly susceptible to theft wherein the criminal smashes the glass and removes as many valuable articles as possible before escaping. Due to the frequency of such "smash and grab" crimes, most retailers choose to remove high-value goods from their display cases at the close of business daily and relocate the merchandise into more secure storage. Unfortunately, the routine transfer of merchandise between the display case and storage causes many problems of its own, not the least of which is the increased labor required to perform the work. Other problems include increased wear and tear on the merchandise and display fixtures, and increase problems with inventory and loss control.

Accordingly, it would be of significant advantage to provide a display case which would secure the merchandise from possible theft without requiring the removal of the merchandise after business hours.

Numerous inventors have addressed the problem outlined above. For example, U.S. Pat. No. 5,733,021 and U.S. Pat. No. 5,791,749 disclose variations of a theft resistant display case, which uses an electric scissor lift mechanism to raise and lower a display platform between an upper display portion of the showcase and a lower storage portion. After the display platform is lowered into the storage portion, a multipiece closure may be interposed between the upper portion and the lower portion to enclose the merchandise in the lower storage portion, where it is more secure from theft. U.S. Pat. No. 5,853,235 discloses a burglar proof jewelry case having an upper and lower portion separated by a hinged display shelf. When a solenoid is energized, (e.g., in association with a burglar alarm), the shelf swings downward and any jewelry sitting on the shelf falls into the lower chamber where it becomes unreachable by a thief. While these and other devices have addressed some of the problems associated with the secure storage of jewelry and other valuables, many problems remain to be solved. For example, the actuating mechanisms of these devices, e.g., the electric scissor lift, tend to be overly complex, expensive and prone to failure. Further, these devices typically require electricity from wall outlets for the actuation of the various mechanisms, which can detrimentally affect cost and reliability. In many cases, the closures used to separate the display portion of the case from the storage portion of the case may be a heavy, complex device having tens or hundreds of components which greatly increases its manufacturing cost. Further, these closures may be too heavy for the average sales person to operate such that electrical power is needed to move the closure as well as to operate the display platform.

When the cabinet is in its display configuration, the unused closure may also require a large storage area on the rear exterior surface of the display case. This is because it is often desirable to simply hang the close on the back of the display case when it is not in use. In this condition, the closure may block access to portions of the display case and may waste space within the housing that could be fitted with doors, drawers, storage bins or the like. A need therefor exists for display case security apparatus which overcomes the obstacles or shortcomings of the prior art.

SUMMARY OF THE INVENTION

The present invention disclosed and claimed herein comprises, in one aspect thereof, a display case security apparatus comprising a housing, a platform, an elevating mechanism, and a closure assembly. The housing includes a lower storage section and an upper display section disposed above the storage section. The storage section has an opaque exterior wall and the display section has an exterior wall which is at least partially transparent. The platform is disposed within the housing and includes a generally horizontal portion for supporting articles to be displayed. The platform is also configured to define a rearward facing recessed space. The platform is selectively movable between a first position, wherein any articles supported on the platform are displayed in the display section of the housing, and a second position, wherein any articles supported on the platform are stored in the storage section of the housing. The elevating mechanism is mounted within the storage section and connected to the platform. The elevating mechanism is selectively moveable between an extended configuration and a retracted configuration, whereby the platform moves between the first position and the second position when the elevating mechanism moves between the extended configuration and the retracted configuration respectively. The closure assembly is constructed with a first plate joined to a second plate by at least one hinge. The first plate of the closure assembly may be selectively inserted into the recessed space of the platform when the platform is in the first position. Both plates of the closure assembly may be selectively inserted between the display section and the storage section when the platform is in the second position, whereby the platform and any articles supported thereon are enclosed within the storage section of the housing.

The present invention disclosed and claimed herein comprises, in another aspect thereof, a method of operating a display case security apparatus comprising a housing, a platform, an elevating mechanism, and a closure assembly. The housing includes a lower storage section and an upper display section adjacent the storage section. The platform is configured to define a rearward facing recessed space. The platform is selectively movable between a first position, wherein any articles supported on the platform are displayed in the display section of the housing, and a second position, wherein any articles supported on the platform are stored in the storage section of the housing. The elevating mechanism is mounted within the storage section and connected to the platform. The elevating mechanism is selectively moveable between an extended configuration and a retracted configuration, whereby the platform moves between the first position and the second position when the elevating mechanism moves between the extended configuration and the retracted configuration respectively. The closure assembly is constructed with a first plate joined to a second plate by at least one hinge. The first plate of the closure assembly may be selectively inserted into the recessed space of the platform when the platform is in the first position. Both plates of the closure assembly may be selectively inserted between the display section and the storage section when the platform is in the second position. Starting from the secured state in which the platform is in the second position and both plates of the closure assembly are fully inserted, the method of operation comprises the steps of: sliding the closure assembly horizontally rearward until both plates are completely withdrawn from the housing; activating the elevating mechanism to raise the platform into the first position; and re-inserting the first plate of the closure assembly through the closure slot of the housing and into the recessed space of the platform.

BRIEF DESCRIPTION OF THE DRAWINGS

For a more complete understanding of the present invention and the advantages thereof, reference is now made to the following description taken in conjunction with the accompanying Drawings in which:

FIG. 1 illustrates a front perspective view of the apparatus;

FIG. 2 illustrates a rear elevation view;

FIG. 3 illustrates a cross-sectional side elevation view;

FIG. 4 is a front perspective view;

FIG. 5 is a rear elevation view with portions of the rear wall broken away to show interior details of the storage section;

FIG. 6 is a cross-sectional side elevation view;

FIG. 10 is a rear elevation view;

FIG. 11 is a front elevation view;

FIG. 12 is a cross-sectional front view with the platform in the raised position;

FIG. 13 is a cross-sectional side elevation view with the platform in the raised position;

FIG. 14 is a cross-sectional side view with the platform in the lowered position;

FIG. 15 is a cross-sectional side elevation view with the platform in the lowered position;

FIG. 16 is a rear elevation view;

FIG. 17 is a front elevation view;

FIG. 18 is a cross-sectional front view with the platform in the raised position;

FIG. 19 is a cross-sectional side elevation view with the platform in the raised position;

FIG. 20 is a cross-sectional front view with the platform in the lowered position;

FIG. 21 is a cross-sectional side elevation view with the platform in the down position;

FIG. 23 is a side elevation view with the modified platform in the lowered position and the closure assembly fully inserted into the housing;

FIG. 24 is a side elevation view with the modified platform in the raised position and the closure assembly fully withdrawn from the housing;

FIG. 25 is side elevation view with the modified platform in the raised position and the closure assembly partially re-inserted into the housing;

DETAILED DESCRIPTION OF THE INVENTION

Figure 1:
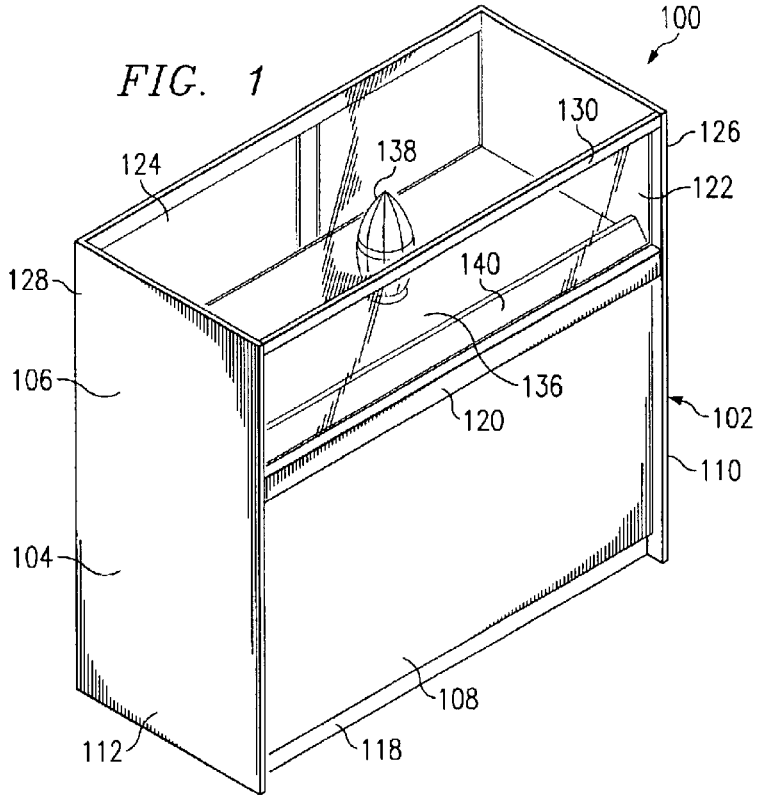
FIGS. 1–3 illustrate one embodiment of a display case security apparatus wherein the platform is in the raised position. Specifically.
Figure 2:
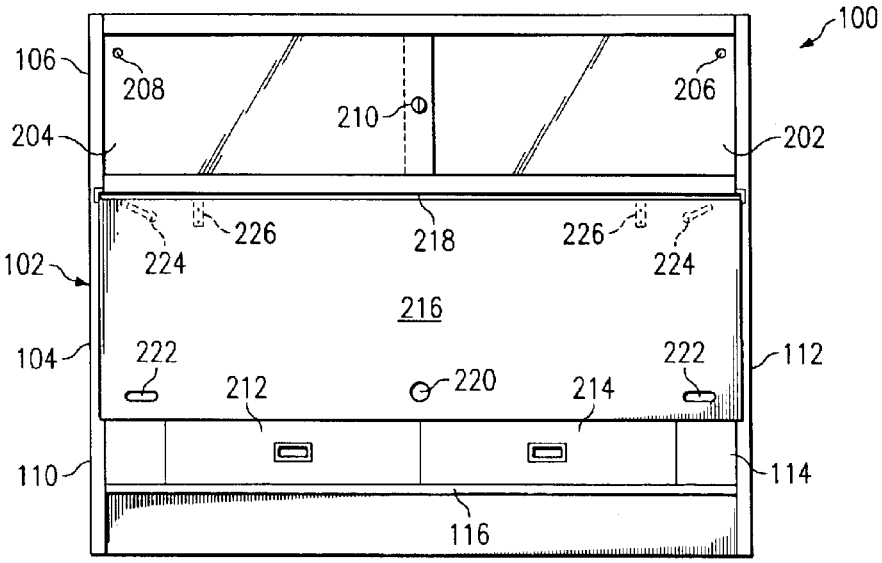
Figure 6:
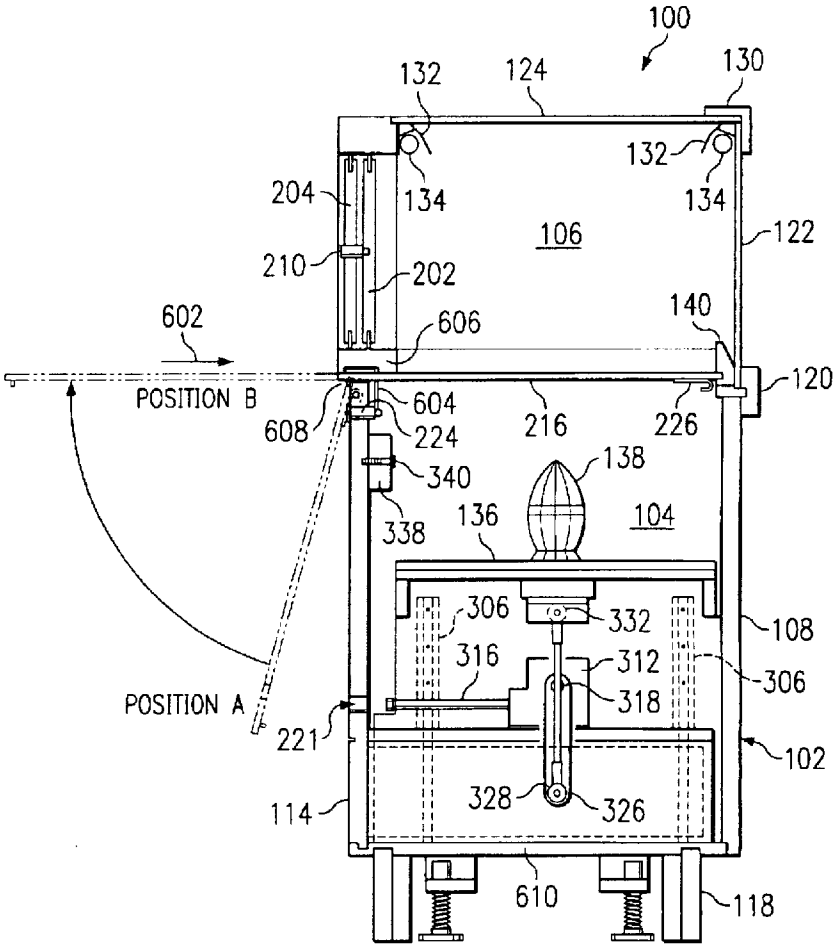
FIGS. 4–6 illustrate the display case security apparatus of FIG. 1 wherein the platform is in the lowered position. Specifically.
Figure 3:
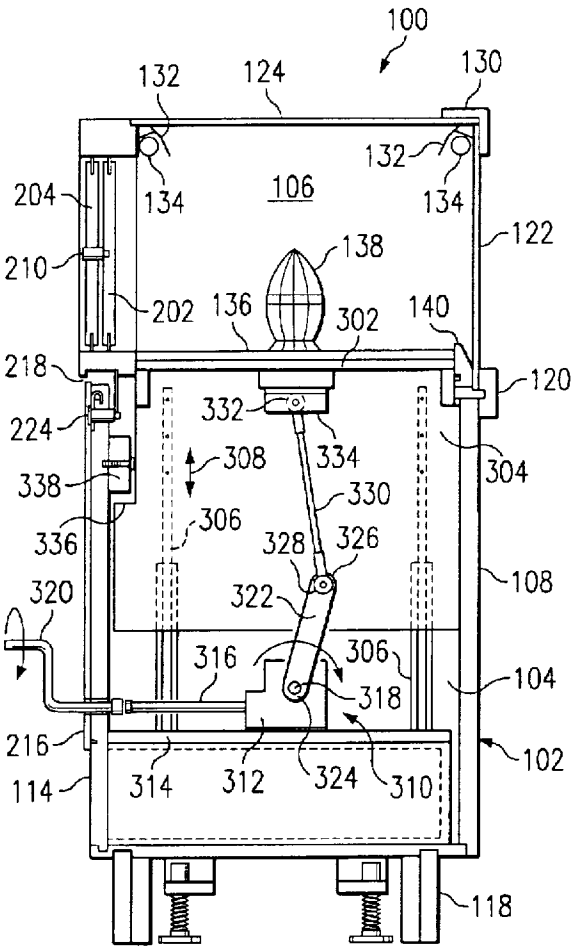
Figure 4:
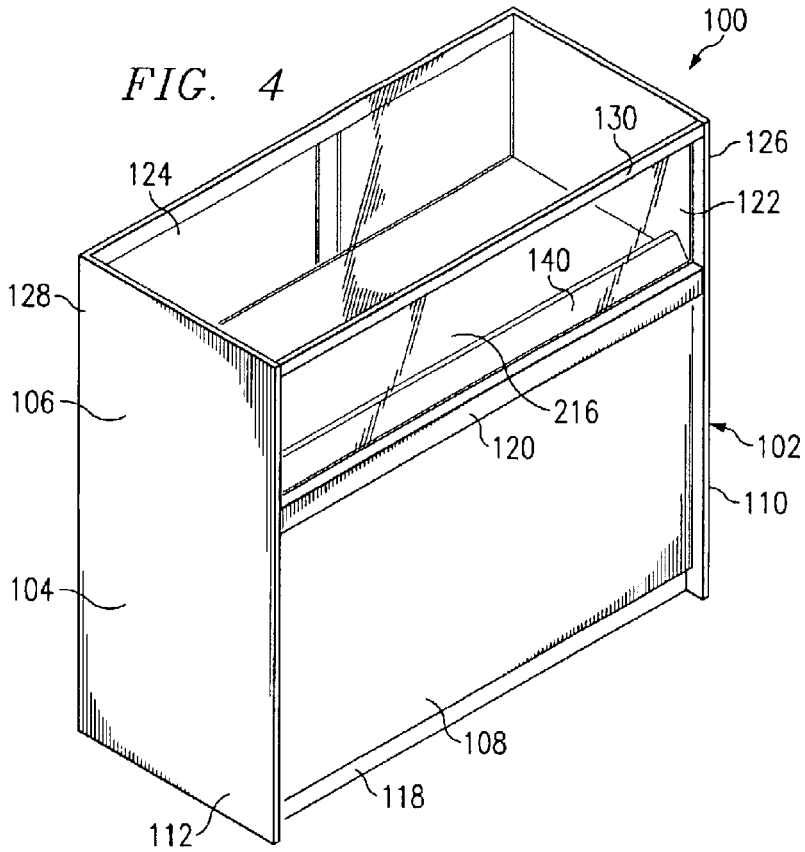
Figure 5:
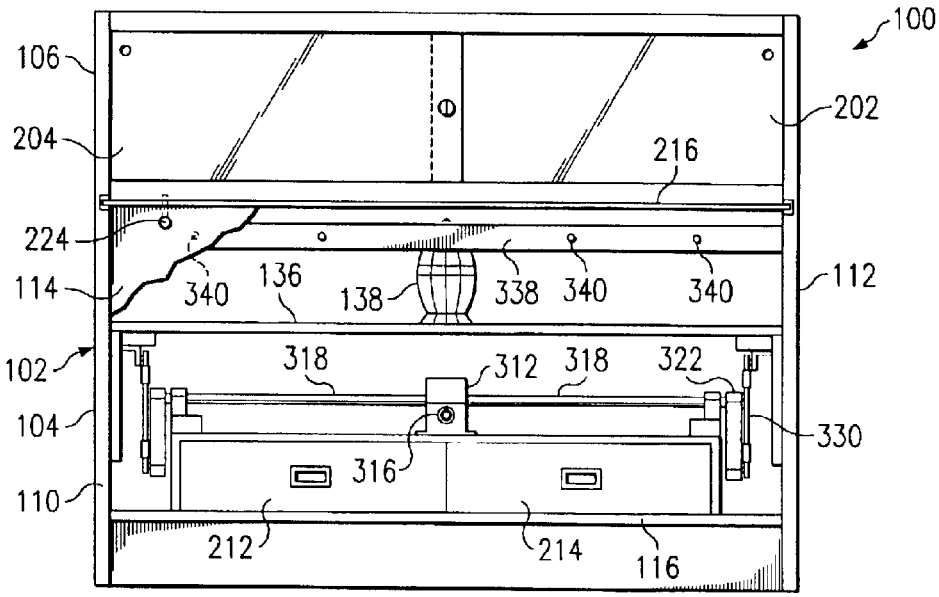

Referring now generally to FIGS. 1–6, there is illustrated one embodiment of a display case security apparatus in accordance with the current invention. In FIGS. 1–3, the apparatus is illustrated with the movable platform in the raised position. In FIGS. 4–6, the apparatus is illustrated with the platform in the lowered position. The display case security apparatus 100 comprises a housing 102 including a lower storage section 104 and an upper display section 106. The lower storage section 104 is defined by four interconnected exterior walls 108, 110, 112, and 114 that form the front, sides and rear of the storage section, respectively. The exterior walls surround a floor 116 (FIG. 2) that is disposed above a base 118. In the embodiment shown, the upper edge of the lower section 104 mounts a trim rail 120 that extends across the front of the display case and finds the lower boundary of the display section 106.

Referring specifically to FIG. 1, the exterior walls 108, 110, 112 and 114 that form the storage section 104 are typically constructed of a suitable wood, wood laminate (e.g., plywood), or wood composite (e.g., particle board) material. In some embodiments, fiberglass, metal or composite combinations of these materials may be used for the walls of the storage compartment. Regardless of the material used, the walls of the lower section should be opaque so that any articles stored in the storage section 104 will be hidden from view.

The display section 106 is generally constructed in accordance with conventional display case construction practices.

Accordingly, the display section 106 has exterior walls which are at least partially transparent. It will be understood that in this context, a wall which is at least partially transparent means that at least a portion of the wall is entirely transparent. Typically, the front wall 122 and the top wall 124 will be entirely transparent, constructed of tempered or laminated glass. Alternatively, Lexan or other break resistant plastic materials may be used. The remaining walls of the display section 106 may be either fully transparent, partially transparent, or opaque, as desired. In the embodiment shown, the upper side walls 126 and 128 are unitarily formed with the corresponding lower side wall 110 and 112 respectively. The walls of the display section 106 may be joined together by frame members in a conventional manner. In the embodiment illustrated, a metal frame member 130 is provided to join the front wall 122 and the top wall 124. A light reflector 132 and light 134 may be inconspicuously positioned behind the frame member 130 in order to provide illumination for the inside of the display case.

As best seen in FIG. 2, access into the display section 106 may be provided through one or more display doors formed in the rear of the case. In the embodiment shown, two sliding doors 202, 204 are provided. A pair of finger pulls 206, 208 are provided on the rear surface of the door to facilitate their operation and a conventional cylinder lock 210 is provided for securing the doors in the locked position. It will of course be appreciated that the lock 210 provides only conventional security for the goods within the display case, i.e., they are still susceptible to a "smash and grab" type theft. The primary security of the apparatus 100 lies in the improved moveable platform mechanism as described further below.

A platform 136 is disposed within the housing. The platform 136 includes a generally horizontal portion 302 for supporting articles to be displayed, e.g., article 138. The platform 136 is selectively moveable within the housing 102 as will be further described below. When in the raised position, i.e., as shown FIG. 1, the platform 136 forms the apparent floor of the upper display section 106. A sign shelf 140 may also be provided within the upper display section 106. The sign shelf 140 typically slants rearwardly into the interior of the display section to conveniently support manufacturer's logos, price information, sample products, and/or similar advertising/promotional materials. It will be appreciated that the sign shelf 140 is fixed to the interior of the housing 102 and does not move with the platform 136.

One or more convenience drawers may be provided in the lower portion of the display case housing 102. In the embodiment shown, two convenience drawers 212, 214 are provided. It will be noted that the convenience drawers do not constitute a portion of the lower storage section 104, because they are accessible from the exterior of the housing 102. Instead, these drawers merely provide additional storage space for extra stock or items which would not normally be stored within the display case. As will be shown and described in further detail below, the housing 314 for the convenience drawers 212, 214 actually forms a portion of the floor of the lower storage section 104.

A closure plate 216 may be stored against the rear wall 114 of the housing. In the embodiment shown, the closure plate 216 comprises a one-piece sheet of aluminum which can be inserted into the closure slot 218 extending across the back of the housing 102. An elevating mechanisms aperture 220 is provided on the closure plate 216 which, in cooperation with a corresponding rear wall aperture 221 (FIG. 6) formed in the rear wall 114, allows access to the elevating mechanism 310 housed within the lower storage section 104. Locking slots 222 are also formed through the closure plate 216. The locking slots 222 are engaged by cam locks 224 (shown in phantom) which are mounted in the rear wall 114 of the case. The cam locks 224 are exposed for use when the closure plate 216 has been inserted into the closure slot 218 (as best seen in FIG. 4). One or more hinges 226 may be provided on the closure plate 216 to facilitate its storage on the rear of the case 102 and to further facilitate the correct positioning of the plate prior to its insertion into the closure slot 218.

Referring now specifically to FIG. 3, the interior components and operating mechanisms of the display case security apparatus 100 will be further described. As previously described, the platform 136 includes a generally horizontal portion 302 for supporting articles, e.g., article 138. In this embodiment, the platform 136 further includes end members 304 having a generally vertical orientation. A plurality of platform guide tracks 306 are attached to the interior walls of the housing 102. In the embodiment shown, the guide tracks 306 comprise a ball-bearing equipped track of the type commonly used for guiding drawers (also known as a drawer "glide"). The purpose of the platform guide tracks 306 is to interfit or cooperate with the platform 136 so as to constrain movement of the platform to a vertical translation only. In other words, the guide tracks 306 ensure that the platform 136 can translate vertically (in the direction indicated by arrow 308) while maintaining its orientation. Thus, the generally horizontal portion 302 of the platform 136 will maintain its generally horizontal orientation independent of the vertical movement of the platform.

The platform 136 is thus selectively moveable between a first position (i.e., that shown in FIGS. 1–3) wherein any articles supported on the platform are displayed in the display section 106 of the housing, and a second position (i.e., that shown in FIGS. 4–6) wherein any article supported on the platform are stored in the storage section 104 of the housing. A lift or elevating mechanism 310 is mounted within the storage section and connected to the platform 136.

Figure 7:
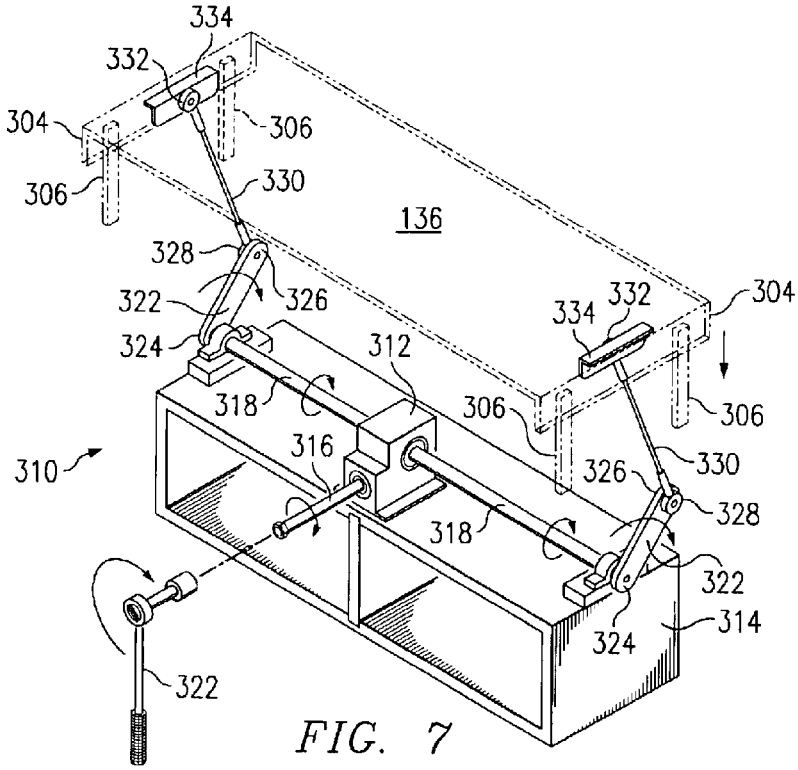
FIG. 7 is a perspective diagram illustrating one embodiment of an elevating mechanism suitable for use in the apparatus.
Figure 10:
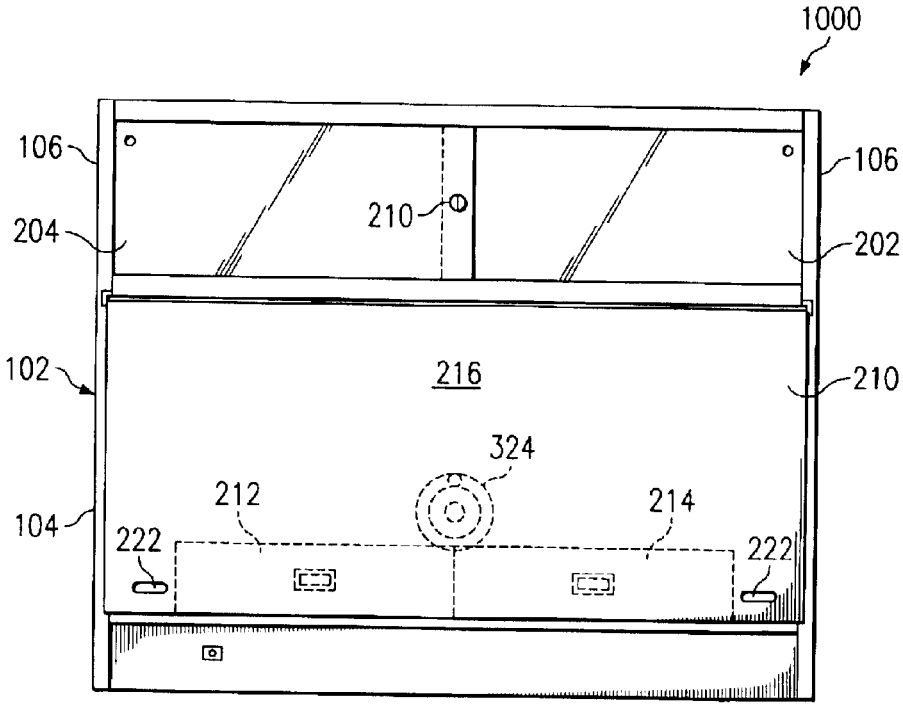
FIGS. 10–15 illustrate another embodiment of the display case security apparatus. Specifically.
Figure 11:
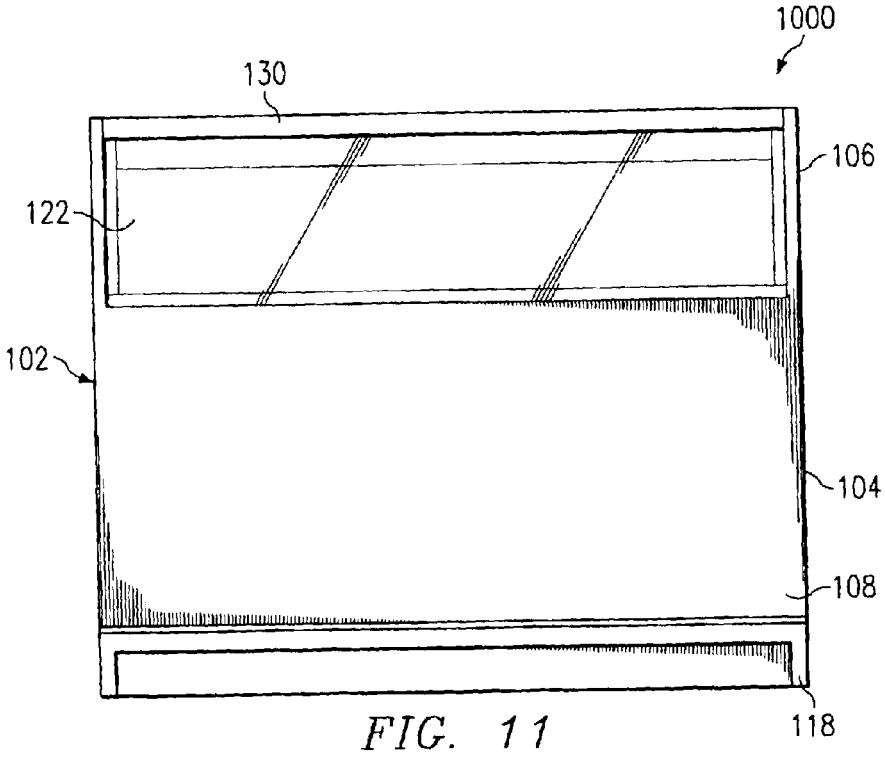
Figure 13:
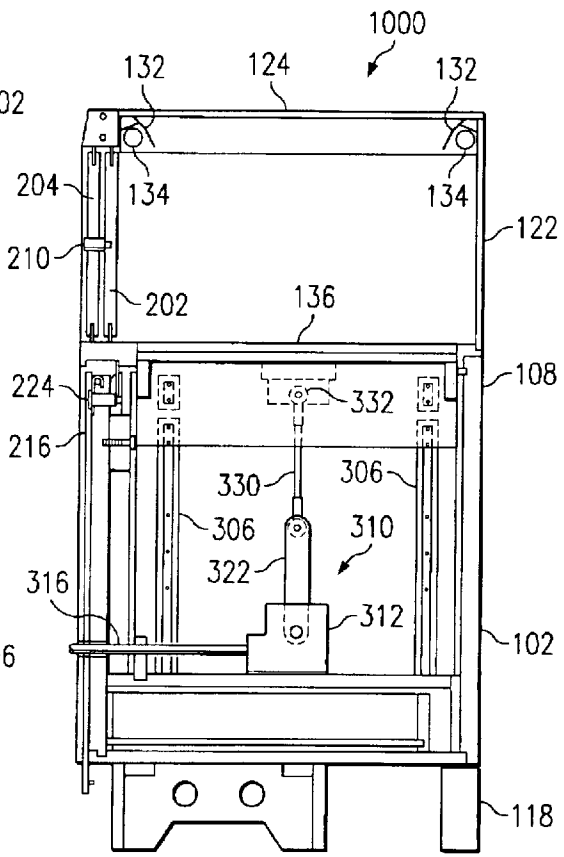
Figure 12:
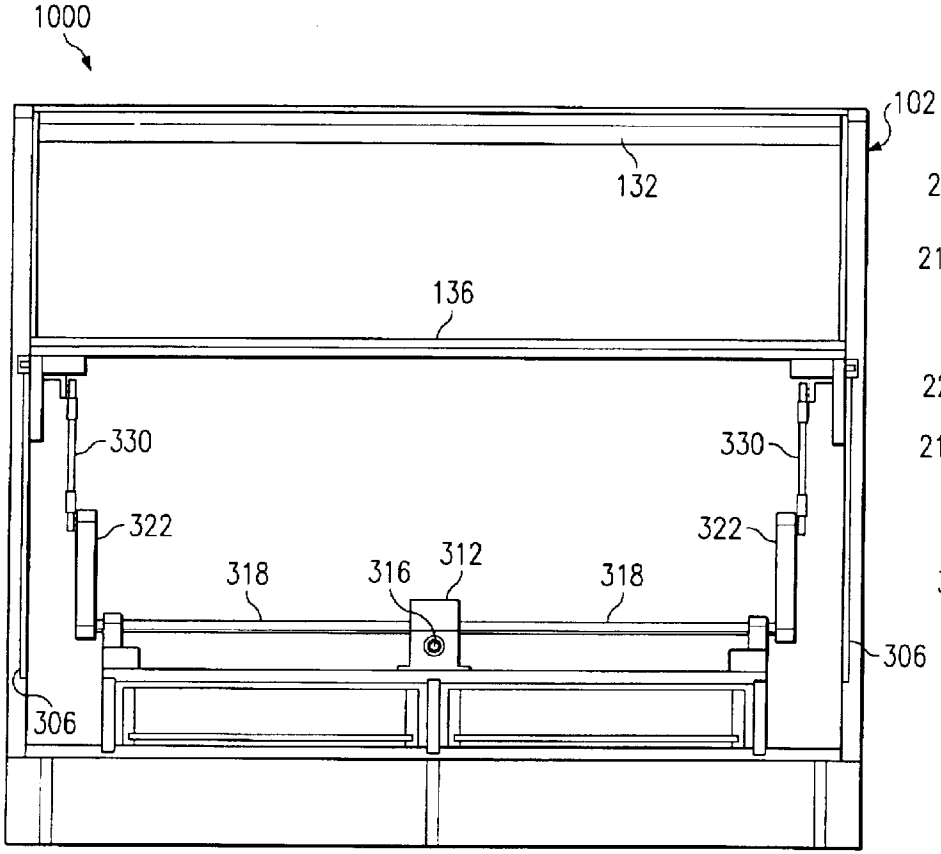
Figure 15:
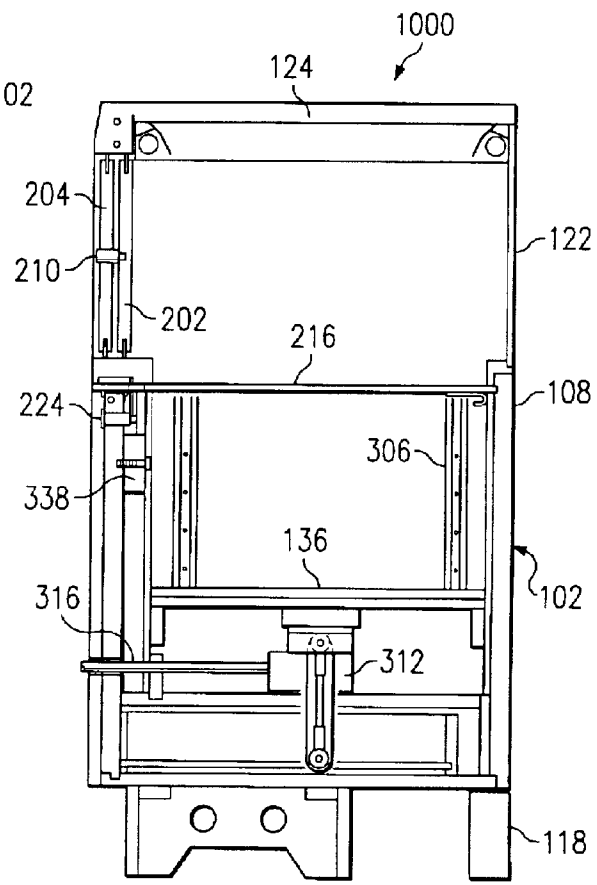
Figure 14:
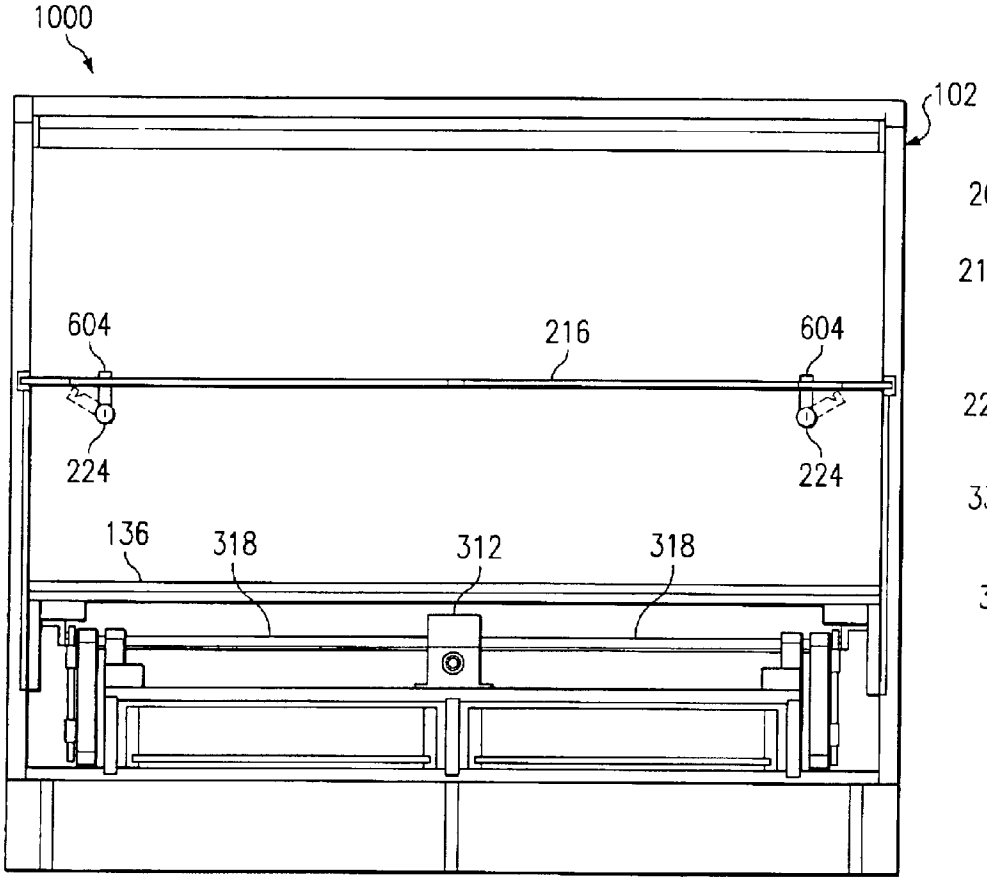

A reduction gear box 312 is mounted on the housing 314 for the convenience drawers 212, 214. An input shaft 316 engages the input portion of the reduction gear box 312 and one or more crankshafts 318 engage the output portion of the reduction gear box. As with any reduction gear box, a first number of rotations of the input shaft 316 will produce a second number of rotations of the crankshaft 318 where the first and second number constitute a predetermined ratio. In the display case security apparatus 100, it has been found that comfortable and convenient manual operation of the elevating mechanism can be obtained with a reduction gear box 312 having a ratio within the range from about 40:1 to about 80:1. In a more preferred embodiment, the predetermined ratio is within the range from about 50:1 to about 70:1. It will be appreciated that the reduction gear box 312 in the illustrated embodiment is a "right angle" drive, i.e., the axis of the input shaft 316 and the axis of the crankshaft 318 lie in planes which form an angle of about 90° to one another. This provides for the convenient orientation of the input shaft 316 near the rear wall of the case 102 such that an actuating device, e.g., a crank 320, a ratchet 322 (e.g., as shown in FIG. 7) or a wheel 324 (e.g., as shown in FIG. 10) can be inserted from the rear of the case to manually actuate the elevating mechanism 310.

The lift or elevating mechanism 310 further includes at least one pair of links. The first link 322 of each pair of links has a first end 324 which engages the crankshaft 318 so as to rotate with it and a second end 326 which is pivotally connected to a first end 328 of the second link 330. Each of the second links 330 has a second end 332 which is pivotally connected to the platform 136. In this case, brackets 334 are used to provide an interface between the second link 330 and the platform 136. Rotation of the crankshaft 318 moves the links 322, 330 of the elevating mechanism 310 whereby the platform 136 moves along the platform guide tracks 306 in a vertical motion as shown by arrow 308. This allows the platform 136 to move between the first position (e.g., FIG. 3) and the second position (e.g., FIG. 6). When the platform is in the second position, any articles 138 on the platform will now be disposed in the storage section 104 of the case, ready to be secured by the positioning of the closure plate 216.

If it is desired to provide positive stops on the elevating mechanism, these may be provided by forming notches 336 in the side plates 304 of the platform 136. These notches 336 engage fixed members, e.g., rear cross-member 338, when the platform 136 is in the first (i.e., fully-raised) position. Similarly, stops for the downward travel of the platform 136 may be provided. In alternative embodiments, travel stops may be provided by placing blocks which limit the travel of the first link 322 and/or the second link 330 of the elevating mechanism rather than by blocking [the platform] travel of the platform 136. In yet other embodiments, the links 322 and/or 330 may be selected such that the upper travel limit is defined by the top dead center (TDC) position of the two links and the lower travel limit is defined by the bottom dead center (BDC) position of the two links. In this situation, no physical stops are required to limit the travel of the platform 136 in the upward or downward direction. Further, when utilizing the TDC/BDC principle to define the upper and lower limits of platform travel, it is possible to complete both raising and lowering actions of the platform 136 while turning the input shaft 316 in a single direction, i.e., without reversing the direction of rotation for the input shaft or the direction of rotation of the crankshaft 318. In alternative embodiments where the elevating mechanism 310 is powered using an electric motor, use of the TDC/BDC principle would allow a single direction (i.e., non-reversing) electrical motor to be used for raising and lowering the platform 136. It will be appreciated that in such cases the crankshaft 318 rotates in a single direction while the platform 136 reciprocates up and down. This eliminates the need for a reversing switch or other circuitry to reverse the direction of the input shaft's rotation in order to reverse the direction of travel of the platform as is required in other types of elevating mechanisms.

Figure 8:
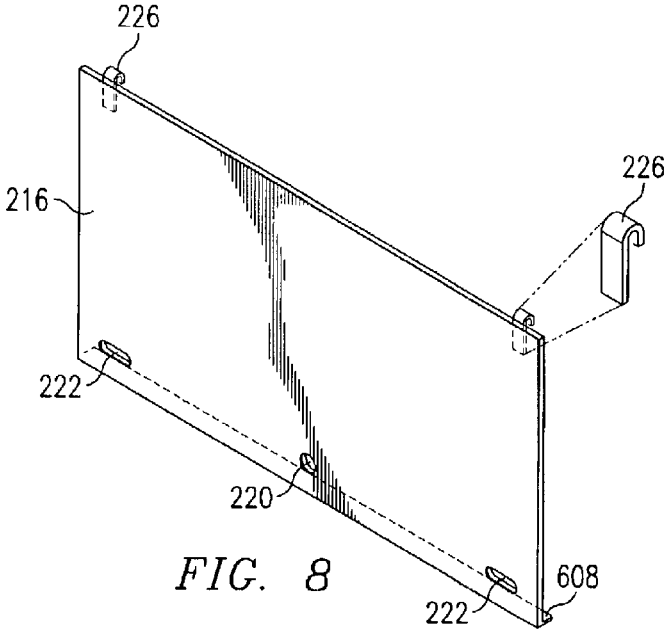
FIG. 8 is a perspective view illustrating the details of one embodiment of a closure plate including an enlarged view of the hinge.

Referring now to FIGS. 4–6, the display case security apparatus 100 is illustrated with the platform 136 in the second position, i.e., with the platform and displayed articles 138 disposed in the storage section 104 of the case 102. Once the platform has been moved into this position, the closure plate 216 maybe moved from its storage position, i.e., hanging against the back wall 114 of the case 102 and placed into the closure slot 218 between the display section 106 and the storage section 104. Referring now also to FIG. 8, there are illustrated details of the closure plate 216. In a preferred embodiment, the closure is a one-piece sheet of aluminum alloy having a generally uniform thickness within the range of about ⅛" to about ¼". A thickness of about 3⁄16" has proven to work well. By utilizing aluminum alloy, an extremely tough closure plate 216 is obtained, yet it is very light in weight such that the plate can be manually lifted from its rest position (FIG. 3) through the position designated "POS. A" in FIG. 6 to the generally horizontal designated position "POS. B" in FIG. 6, without putting undue strain on the salesperson performing the task. Once the closure plate 216 has been raised into the "POS. B" configuration, it is simply pushed into place in the direction of arrow 602. It will be noted that as the closure plate 216 is pushed forward, the hinge hook 226 will automatically detach from the rear wall 114 of the case and move forward with the plate. Once the plate 216 has been put in the closed position, i.e., interposed between the display section 106 and the storage section 104, the cam locks 224 mounted on the rear wall 114 of the case can be activated. The latch 604 of the cam lock 224 moves through the latching slot 222 in the closure plate 216 and engages a slot in the structural member 606 immediately above the cam lock, thus preventing withdrawal of the closure plate. It will be noted that the lip 608 on the closure plate 216 extends downwards from the plate to prevent a criminal from attempting to defeat the cam lock latch 604.

Once the platform 136 has been moved into the second position and the closure plate 216 moved into position and locked using cam locks 224, articles 138 supported on the platform are protected from "smash and grab" theft. In fact, the case 102 appears empty as illustrated by FIG. 4. The display case security apparatus 100 provides additional security features to minimize the likelihood that a thief will be able to obtain access to the storage section 104 of the case in a short period of time. One example of such enhanced security features is the fact that the exterior walls of the lower storage section 104 are secured using no externally accessible fasteners. As best seen in FIG. 5, the rear wall 114 is secured to the interior cross-member 338 using a plurality of fasteners 340, which are inserted from the interior of cross-member 338. Thus, removing the rear wall 114 (which must be provided for in case maintenance on the elevating mechanism 310 is required) requires that the closure plate 216 be withdrawn, at which point, the fasteners 340 may be withdrawn from the interior side of cross-member 338, allowing wall 314 to swing backwards and disengage the slot 610 running across the bottom of the case.

Figure 9:
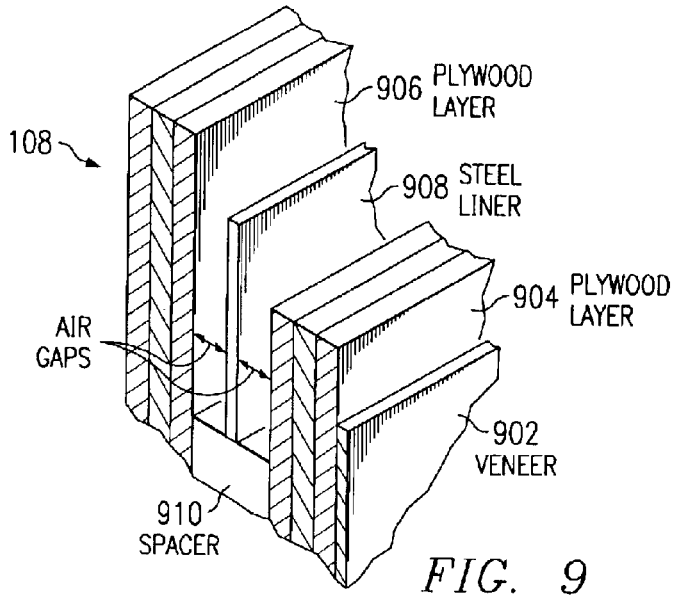
FIG. 9 is an enlarged cross-sectional perspective view of the lower storage section exterior wall.

Referring now to FIG. 9, there is illustrated an enlarged cross-sectional view of a portion of the exterior wall of the lower storage section 104, in this case a portion of the front wall 108. It is conventional to provide a shield or liner of thin metal inside the wooden cabinet. The metallic liner understood to provide additional protection against saw-through attacks against the case. In the prior art, however, the metallic liner is affixed to the interior of the wooden structure using fasteners such as rivets, bolts, nails, etc. It has now been discovered that this direct attachment of the liner to the cabinet structure actually reduces the effectiveness of the liner in preventing saw-through attacks. Thus, in the current invention, the metallic liner is not affixed to either the interior or exterior walls of the cabinet. Rather, it "floats" in a slot formed between two spaced-apart layers of cabinet material. In the example shown in FIG. 9, the exterior wall 108 comprises veneer 902 over a plywood panel 904 which is spaced-apart from an interior panel 906 which is also made of plywood. A thin metallic liner 908 is placed in the slot 910 between the two plywood layers 904, 906. The metallic liner 908 is not affixed to either layer 904 or 906, but merely rests within the slot 910 such that it may float if it is disturbed by, e.g., a reciprocating saw blade or other attack upon the cabinet. In one embodiment, the inner and outer plywood layers 906, 904 are formed of ¾" plywood material while the metallic liner 908 has a thickness of substantially less than 1⁄16". In another embodiment, the outer layer is made from ¾" plywood while the inner layer is made from ¼" melamine or other composite wood product. Again, a metallic liner having a thickness substantially less than 1⁄16" is placed in a slot formed between the two wooden layers but not firmly affixed to either layer.

Referring now to FIGS. 10–15, there is illustrated another embodiment of a display case security apparatus. The display case security apparatus 1000 has many elements which are substantially identical to those previously described for the display case security apparatus 100 (FIGS. 1–9). These elements are therefore denoted using the same reference numbers.

Referring now to FIGS. 16–21, there is illustrated another embodiment of a display case security apparatus. The display case security apparatus 1600 has many elements which are substantially identical to those previously described for the display case security apparatus 100, 1000. These elements are therefore denoted using the same reference numbers.

Figure 22:
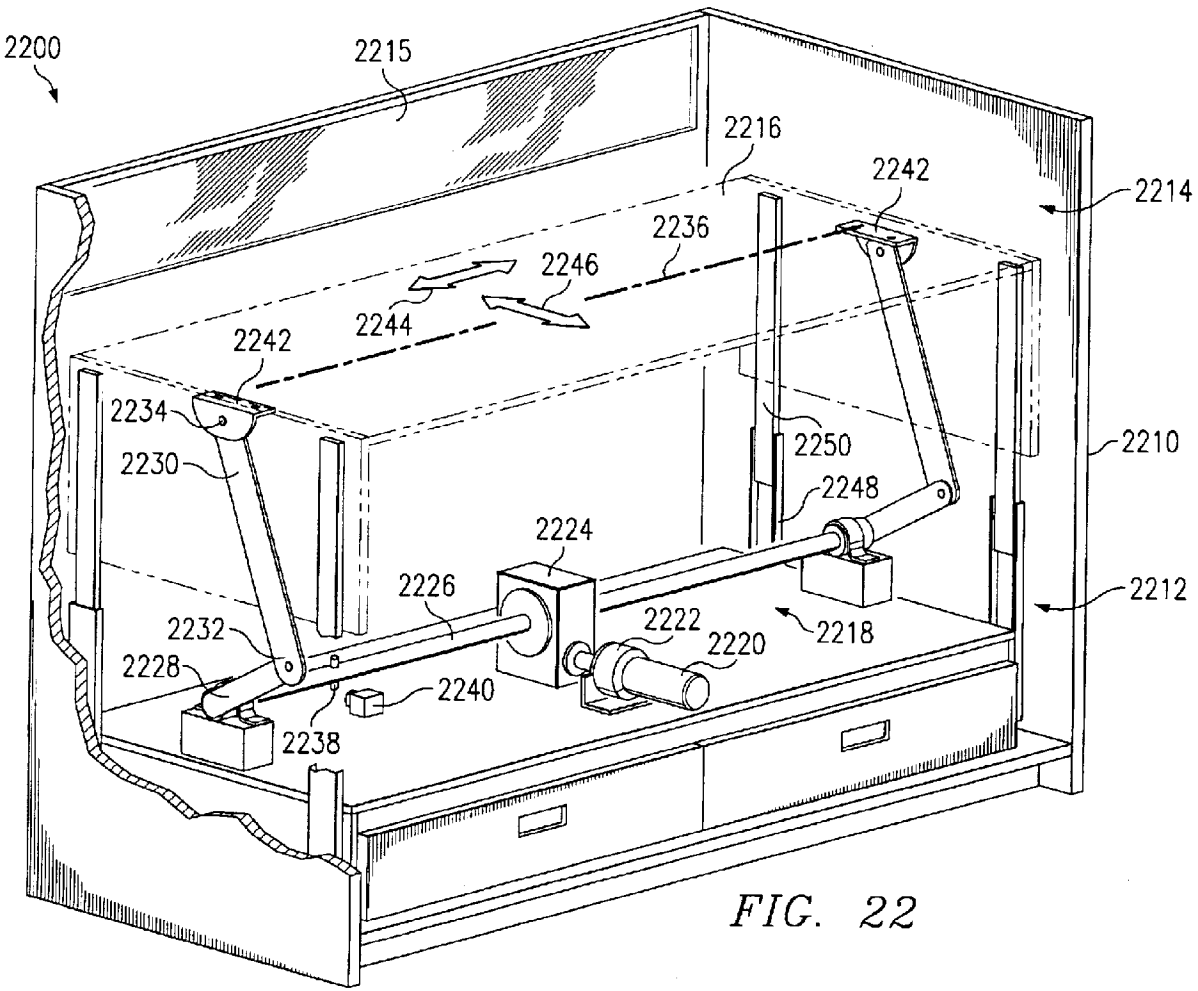
FIG. 22 is a rear perspective view of an yet another embodiment of a display case security apparatus with portions broken away for purposes of illustration.

Referring now to FIG. 22, there is illustrated yet another embodiment of a display case security apparatus, this embodiment incorporating an electrically powered lift mechanism. The display case security apparatus 2200 includes a housing 2210 including a lower storage section 2212 and an upper display section 2214 with transparent display window 2215. A movable platform 2216 (shown in broken line for purposes of illustration) is mounted in the housing using guides or slides 2248, 2250 which constrain the movement of the platform to vertical, i.e., up-and-down, motion only. The apparatus 2200 further includes an electrical elevating mechanism 2218 with an electric motor 2220 ("the Drive Motor") having an output shaft (not shown) that always rotates in the same direction (i.e., it does not reverse direction) during operation. The output shaft of the Drive Motor 2220 is connected to an in-line reduction gear mechanism 2222 ("the Primary Reducer"), which, in turn is connected to a right-angle reduction gear mechanism 2224 ("the Secondary Reducer") such that when the Drive Motor is operated, the output of the Secondary Reducer always rotates in the same direction. The output of the Secondary Reducer 2224 is connected to a crankshaft 2226, which, in turn has a crank arm 2228 connected to each end such that when Drive Motor 2220 is operated, the crankshaft 2226 rotates and the outer end of each crank arm 2228 revolves in a circle, always in the same direction. A connecting arm 2230 is pivotally connected between the outer end of each crank arm 2228 (at the point designated 2232) and the respective underside end of the movable platform 2216 (at the point designated 2234) to allow relative angular movement, but no sliding movement, between the respective components. When the Drive Motor 2220 operates, the lower end of each connecting arm 2230 revolves in a circle around the crankshaft (always in the same direction), thereby causing the upper ends of the connecting arms (which are attached to the platform 2216 that is constrained to move in the vertical direction only) to reciprocate, i.e., to move alternately up and down. The platform 2216, which is supported by the upper ends of the connecting arms 2230, is thereby alternately raised into the display section 2214 of the housing and lowered into the storage section 2212 of the housing as the Drive Motor 2220 operates in a single direction.

It will be appreciated that the elevating mechanism of this embodiment has no intrinsic stopping point while operating. Instead, as long as the Drive Motor 2220 operates (rotating in a single direction), the elevating mechanism will continuously raise and lower the platform 2216 without requiring the direction of rotation of any part of the mechanism to be reversed. Therefore, a cam member 2238 is disposed on the crankshaft 2226. The cam member 2238 cooperates with a sensor 2240, which may be a contact switch, a magnetic detector, an optical detector, or other such device, to determine the rotational position of the crankshaft 2226, and thus also the position of the platform 2216 such that the raising and lowering operation may be stopped at the desired point. It will also be appreciated that the elevating mechanism of this embodiment may be actuated to both raise and lower the platform using only a simple two-state switch (i.e., on-off). It will still further be appreciated that an electric motor of the type operated on AC electrical power or of the type operating on DC electric power may be employed for the Drive Motor 2220, depending upon the type of power available, preference of the user, or other considerations.

It will be further appreciated that the elevating mechanism of this embodiment has only two points of contact with the display platform 2216, namely at points 2242 where the connecting arms 2230 are connected to the underside of the platform along the longitudinal axis 2236 that runs in the side-to-side direction (i.e., as indicated by arrow 2244). These are insufficient, by themselves, to stabilize the platform 2216 in the front-to-back direction (indicated by arrow 2246). Consequently, the platform 2216 is stabilized in the front-to-back direction during raising and lowering by the drawer guides 2248, 2250 at each of the four comers of the platform.

Figure 24:
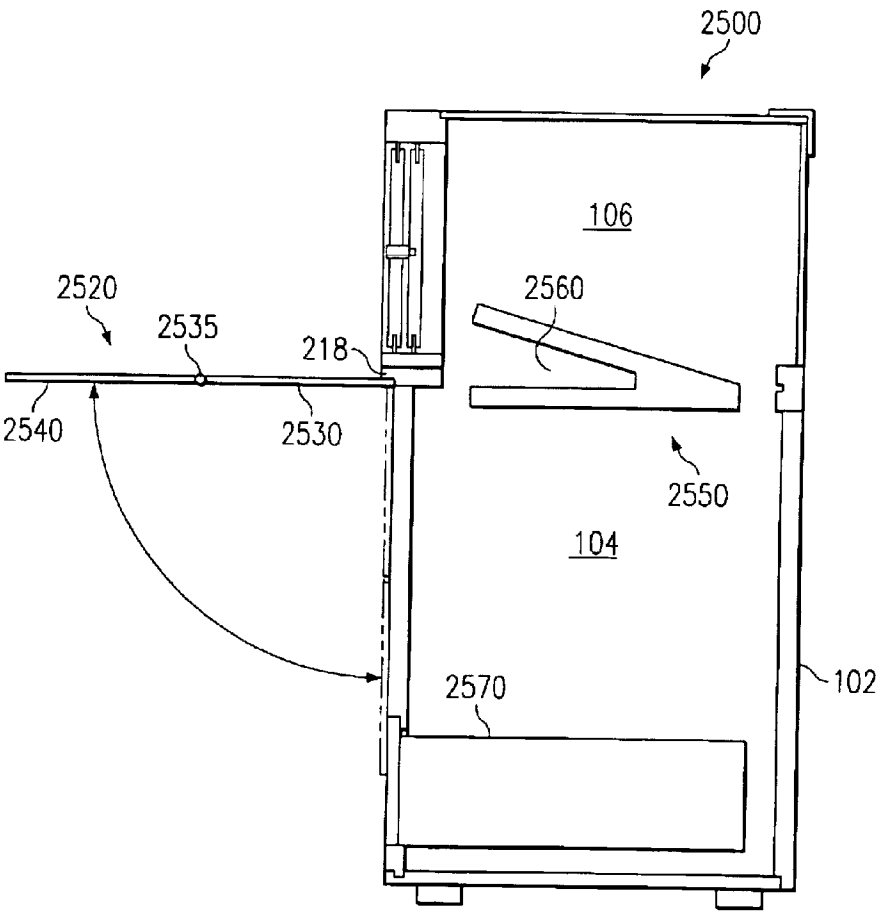
FIGS. 23–25 illustrate yet another embodiment of a display case security apparatus. Specifically.
Figure 23:
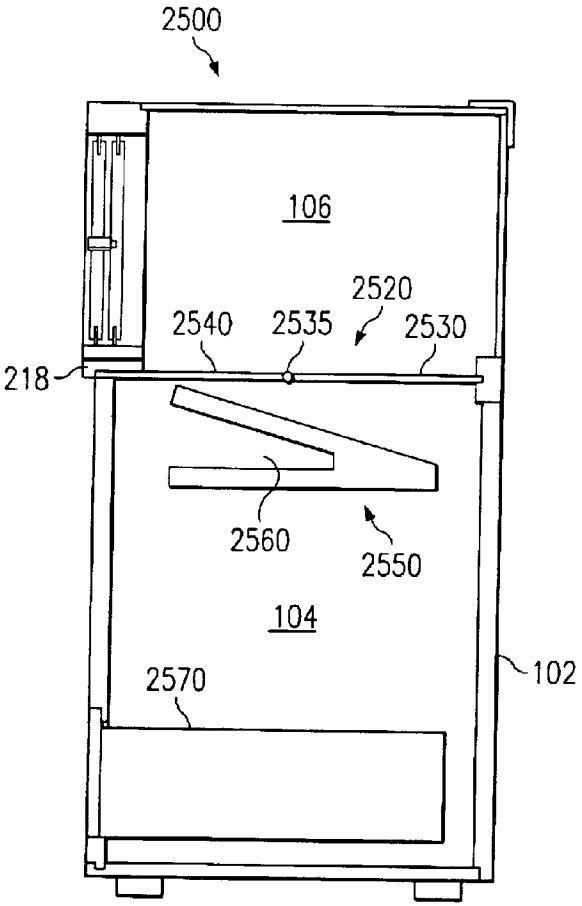
Figure 25:
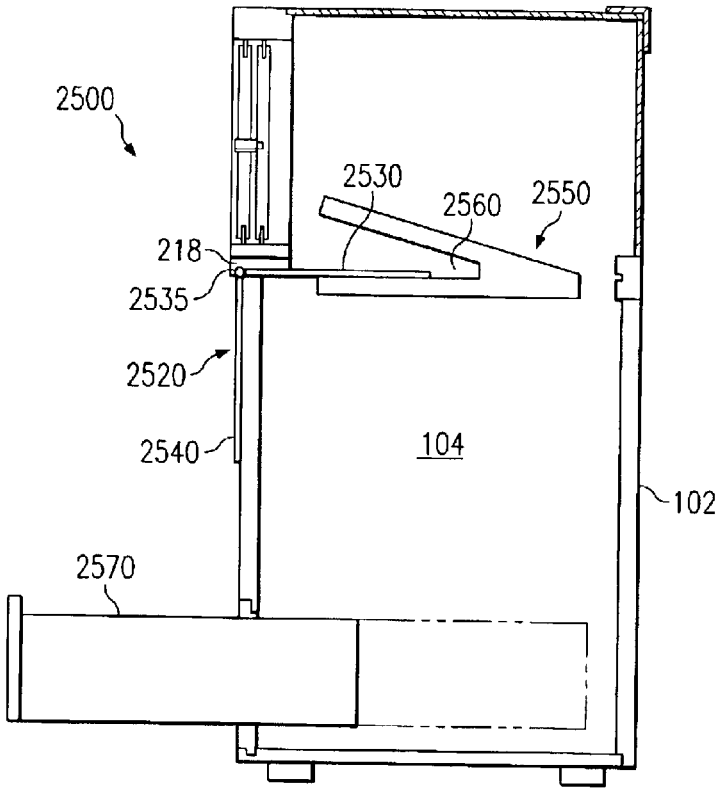

Referring now generally to FIGS. 23–25, there is illustrated an alternative embodiment of a display case security apparatus in accordance with the current invention. In FIG. 23, the apparatus is illustrated with the movable platform in the lowered position. In FIGS. 24–25, the apparatus is illustrated with the platform in the raised position. Although the closure has been modified, the display case security apparatus 3000 has many elements which are substantially identical to those previously described for the display case security apparatus 100, 1000, 1600, 2200. These elements are therefore denoted using the same reference numbers. It is also understood that FIGS. 23–25 are simplified drawings that do not show the lifting mechanism. Although a lifting mechanism is present, the type of mechanism is not particularly important to the present invention as long as it moves the platform smoothly between the raised and lowered positions.

Referring now to FIG. 23, the display case security apparatus 2500 is illustrated with the platform 2550 in the lowered position, i.e., with the platform and displayed articles, not shown, disposed in the storage section 104 of the case 102. As shown here, with the platform 2550 in the lowered position, a closure assembly 2520 may be placed into the closure slot 218 between the display section 106 and the storage section 104 of the case 102. It will be appreciated that the platform 2550 of this embodiment has been modified to include a recessed space 2560, the purpose of which will be described in greater detail herein below. As noted earlier in reference to display case security apparatus 100, once the closure assembly 2520 is fully inserted into the housing of the case 102, locks mounted on the rear wall of the case can be activated. With the platform 2550 moved into the lowered position and the closure assembly 2520 slid horizontally into position and locked, the articles supported on the platform will be protected from a typical "smash and grab" theft attempt. The display case 102 also preferably includes a drawer 2570 disposed below the storage section 104 and accessible from the rear exterior of the case.

Still referring to FIG. 23, the closure assembly 2520 may now be described in greater detail. In one preferred embodiment, the closure assembly 2520 is formed of two sheets or plates of aluminum alloy having a generally uniform thickness within the range of about ⅛" to about ¼". A thickness of about 3⁄16" has proven to work well. As noted herein above, by utilizing an aluminum alloy, an extremely tough closure assembly 2520 is obtained which is light enough in weight that it can be manually lifted and slid into position, without putting undue strain on the salesperson performing the task. Of course, it is understood that other metal alloys or composite materials may also be used to construct a suitable closure assembly 2520. The first plate 2530 and second plate 2540 are held together at a single joint by one or more hinges 2535. In one preferred embodiment of the present invention, a single piano hinge, as known in the art, may be used to join the first and second plates 2530, 2540. The first plate 2530 and second plate 2540, joined together by the at least one hinge 2535, may be referred to collectively as a closure assembly 2520. The closure assembly 2520 may be substituted for and used in place of the one piece closure plate 216 as shown and described for the previous embodiments of the display case security apparatus 100, 1000, 1600, 2200.

As best seen in FIG. 23, when the two plates 2530, 2540 are aligned, the closure assembly 2520 may be slid horizontally into the closure slot 218 between the display section 106 and the storage section 104 of the case 102. In one preferred closure assembly 2520, the hinge 2535 is disposed completely below the two plates 2530, 2540 and the hinge and its mounting hardware are completely inaccessible from above. Thus, a potential "smash and grab" theft may not be accomplished by merely removing the hinge 2535 or by unscrewing the hardware holding it in place. It is also notable that while the closure assembly 2520 is secured in the closure slot 218, the two plates 2530, 2540 are held in alignment by the side rails, not shown, thus it is not possible to rotate the first or second plate about the hinge 2535 and the platform 2550 and the displayed articles disposed in the storage section 104 of the case 102 will remain secured.

Referring now to FIG. 24, the modified platform 2550 is shown in the raised position such that articles are disposed in the display section 106 of the case 102. It is noted that before raising the platform, the closure assembly 2520 has been completely withdrawn from the closure slot 218 and the body of the case 102. This is accomplished by the operator by first opening the locks which secure the closure assembly 2520 in the storage position and then sliding the closure assembly straight back such that it extends completely from the rear of the case 102. Once the closure assembly 2520 has been completely withdrawn from the case 102 in the horizontal position, it is then possible to gently lower the closure assembly 2520 and allow it to rotate downward about 90° to come to rest on the back portion of the case 102, as indicated by the phantom lines in FIG. 24. This is essentially the same technique that is used to withdraw or remove and store the one piece closure plate 216 shown and described herein above. As shown here, the closure assembly 2520 blocks access to the storage drawer 2570 on the rear of the display case.

Referring now to FIG. 25, the modified platform 2550 is still in the raised position with articles disposed in the display section 106 of the case 102. However, as shown here, the first plate 2530 of the closure assembly 2520 has been re-inserted into the closure slot 218 and disposed within the recessed space 2560 provided in the modified platform 2550. To achieve this configuration, the modified platform 2550 is raised until the recessed space 2560 is aligned with the closure slot 218 of the case 102. The forward or first plate 2530 of the closure assembly may then be reinserted through the closure slot 218 and into the recessed space 2560 of the modified platform. The rearward or second plate 2540 may then be folded downward or rotated about the hinge 2535 about 90° into a position that is generally perpendicular to the first plate 2530 and allows the second plate to rest in a generally flush position flat against the back of the case 102. Note that the closure assembly 2520 does not extend as far down on the back of the display case 102 and the drawer 2570, shown partially withdrawn in FIG. 25, is accessible from the back of the case.

Thus, by reinserting the first plate 2530 into the modified platform 2550 and folding only the second plate 2540 flat against the back of the case 102, the amount of surface area on the back of the case 102 required for storing the closure assembly 2520 is reduced significantly. In one preferred embodiment, either of the first and second plates 2530, 2540 may comprise about 15% to about 75% of the total width of the closure assembly 2520. In another preferred embodiment, either of the first and second plates 2530, 2540 may comprise about 30% to about 50% of the total width of the closure assembly 2520. Thus, for a first plate that comprises about 50% of the total width of the closure assembly 2520, it is possible to reduce the amount of surface area required for storage on the back of the case 102 by about one-half. Therefore, it is possible to free up otherwise unused or dead space within the case 102 for use in storage with one or more drawers or storage areas built into the lower portion of the case 102 and accessed from the rear of the case.

Figure 16:
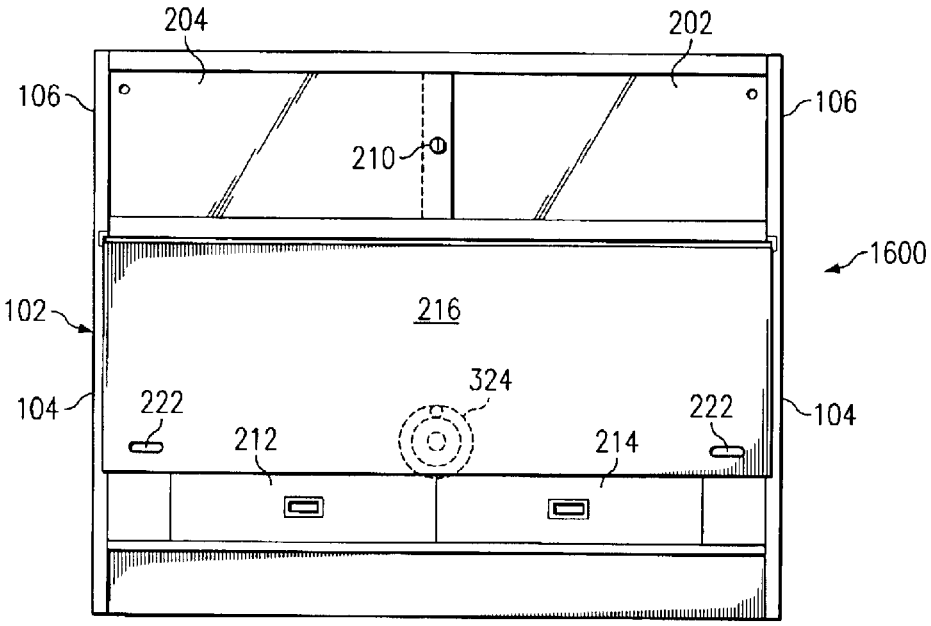
FIGS. 16–21 illustrate yet another embodiment of a display case security apparatus. Specifically.
Figure 17:
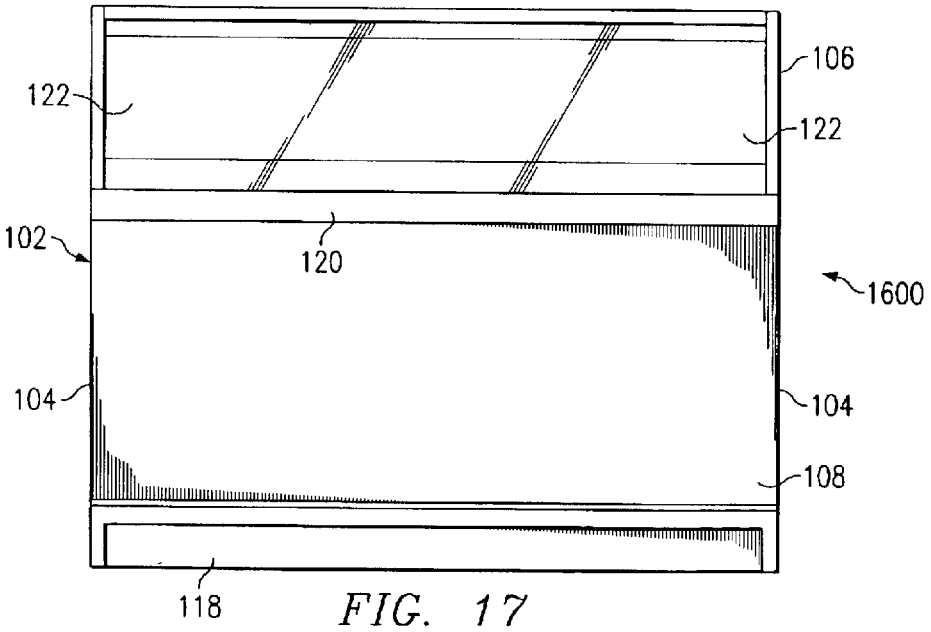
Figure 19:
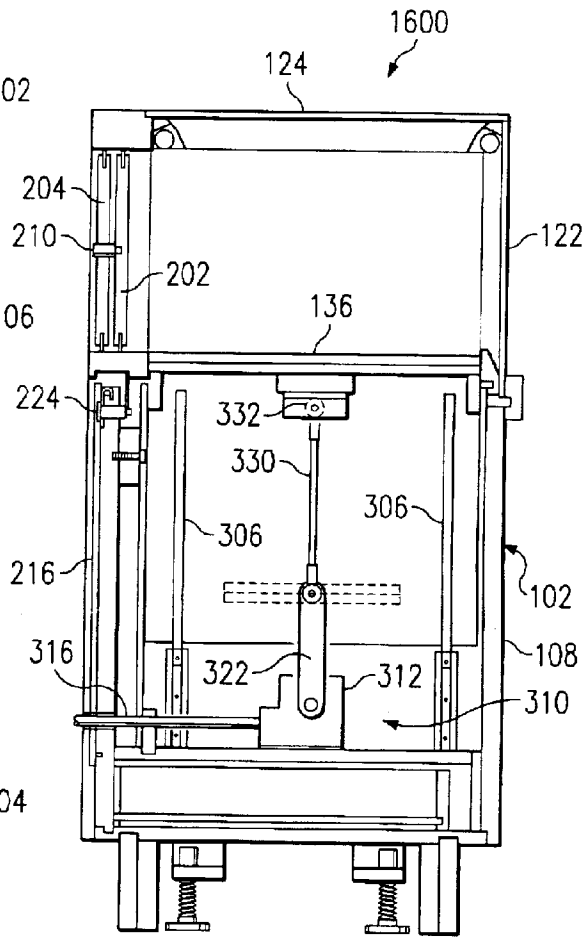
Figure 18:
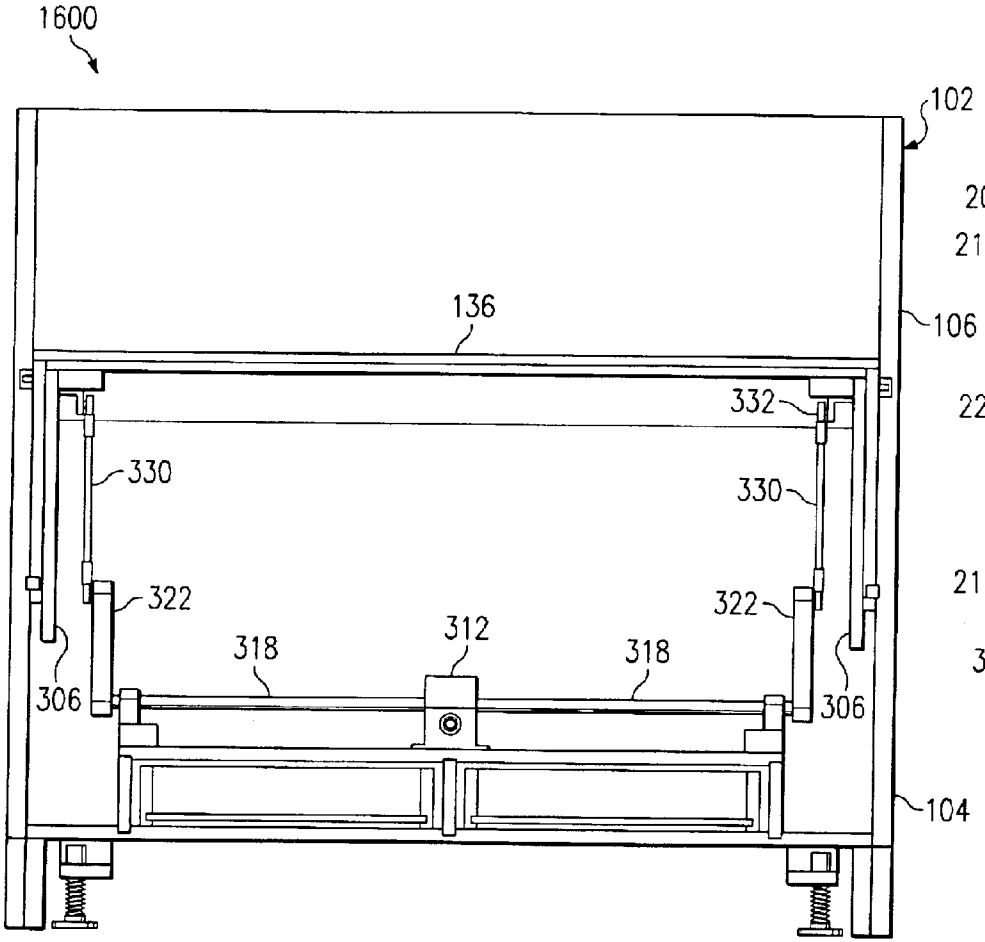
Figure 21:
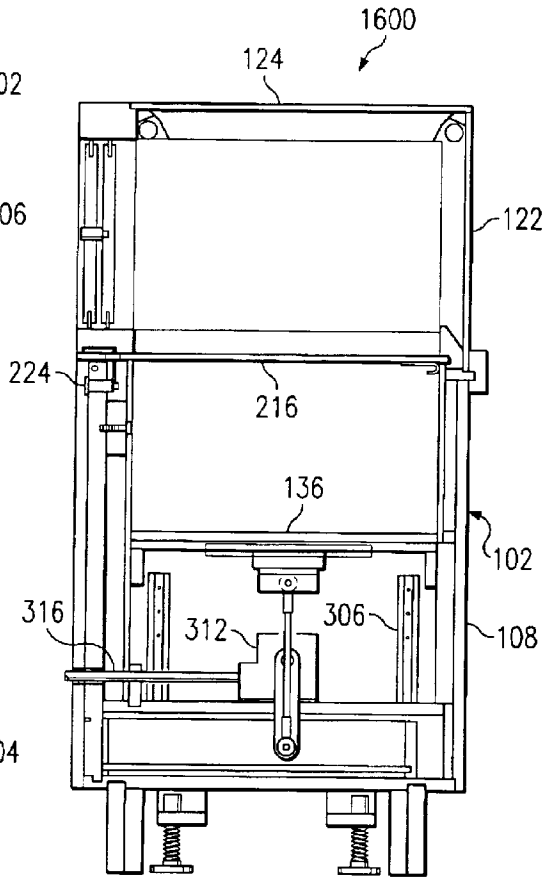
Figure 20:
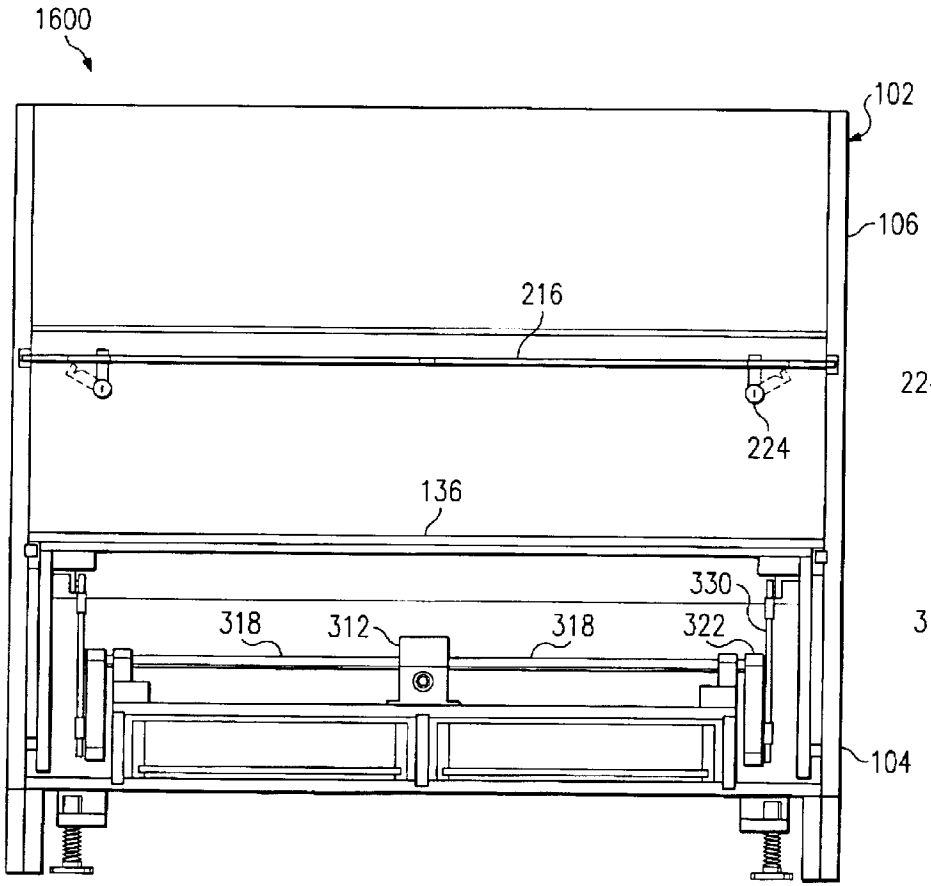

The practical value of the improvement provided by using a hinged closure assembly 2520 and a modified platform 2550 can be better appreciated by referring to FIGS. 10 and 16. As shown in FIG. 10, drawers 212 and 214 which are accessed from the rear of the case 102 are difficult to reach with the plate 216 in the storage position. As shown here, the operator must somehow lift the closure plate 216 while simultaneously opening and accessing the contents of the drawers 212 or 214. Commonly, this will require the assistance of at least one other operator to hold the closure plate while the first operator accesses the contents of the drawers 212 or 214. As shown in FIG. 16, by reducing the dimensions of the closure plate 216, it is possible to access the drawers 212 and 214 without lifting the closure plate 216. However, decreasing the dimensions of the closure plate 216 would, in turn, decrease the dimensions of the platform and the amount of goods which maybe displayed thereon. But, by using a hinged closure assembly and reinserting one portion of the closure assembly into the recessed space within the modified platform, as described herein above, the amount of surface area required for storage on the back of the case 102 is reduced. In this way, the size of the drawers or the amount of storage space accessible from the back of the case 102 by a single operator may be significantly increased. As can be envisioned by looking at FIG. 10, if the portion of the closure assembly hanging down on the back of the case was cut in half, the drawers 212 and 214 could be easily accessed. The depth of these drawers would be limited only by the sweep of the platform within the housing. Alternatively, the number of drawers may be changed or doors for access to one or more storage bins could be used in place of the two drawers shown here.

Figure 26:
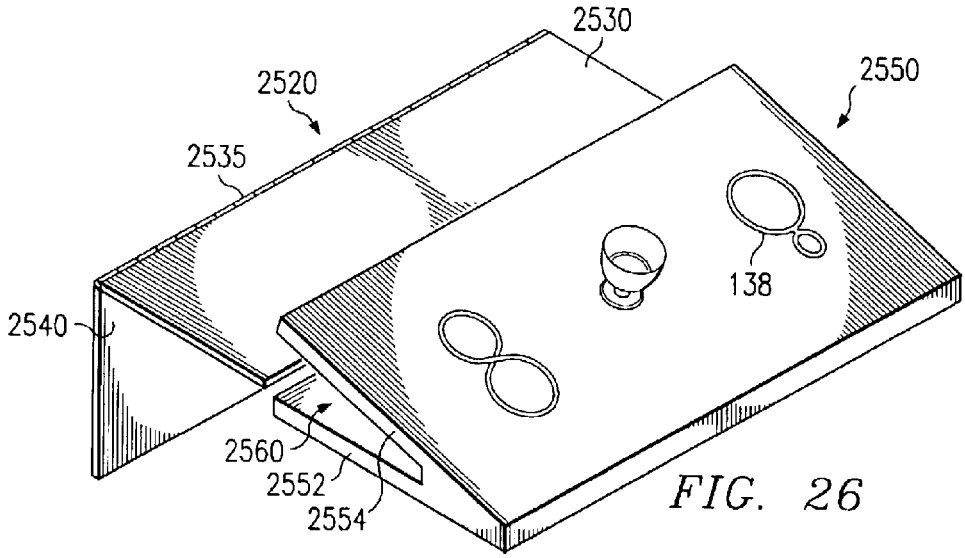
FIG. 26 is a partially exploded perspective view of the modified platform and the closure assembly shown in greater detail.
Figure 27:
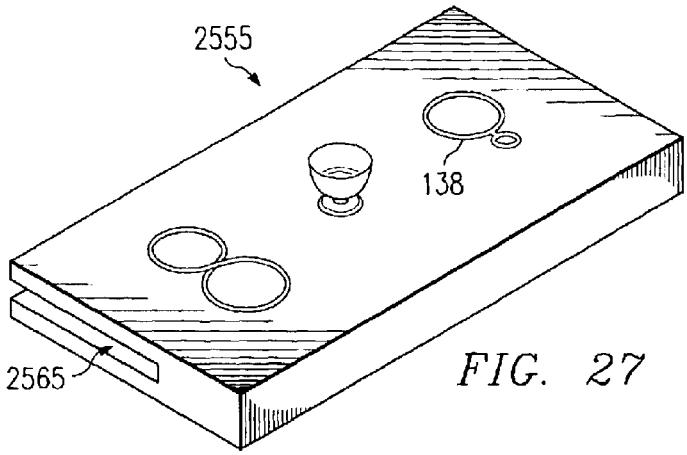
FIG. 27 is a perspective view of an alternative embodiment of the modified platform.

Referring now to FIGS. 26 and 27, perspective drawings are used to illustrate the closure assembly and the modified platform in greater detail. FIG. 26 is a partially exploded detail drawing of the closure assembly 2520 and the modified platform 2550. As shown here, the first plate 2530 of the closure assembly 2520 fits within the recessed space 2560 provided between the lower portion or base 2552 of the platform and the display shelf 2554 used to support the items offered for sale 138. The display shelf 2554 is attached to the base 2552 of the platform along the front edge. FIG. 27 is a detail drawing of an alternative embodiment of the modified platform 2555. In this embodiment, the platform is provided with a storage slot 2565 intended to receive the first plate of the closure assembly, not shown. The upper surface of the platform 2555 is flat and may be used to support a display shelf, not shown, or items offered for sale 138.

Figure 28:
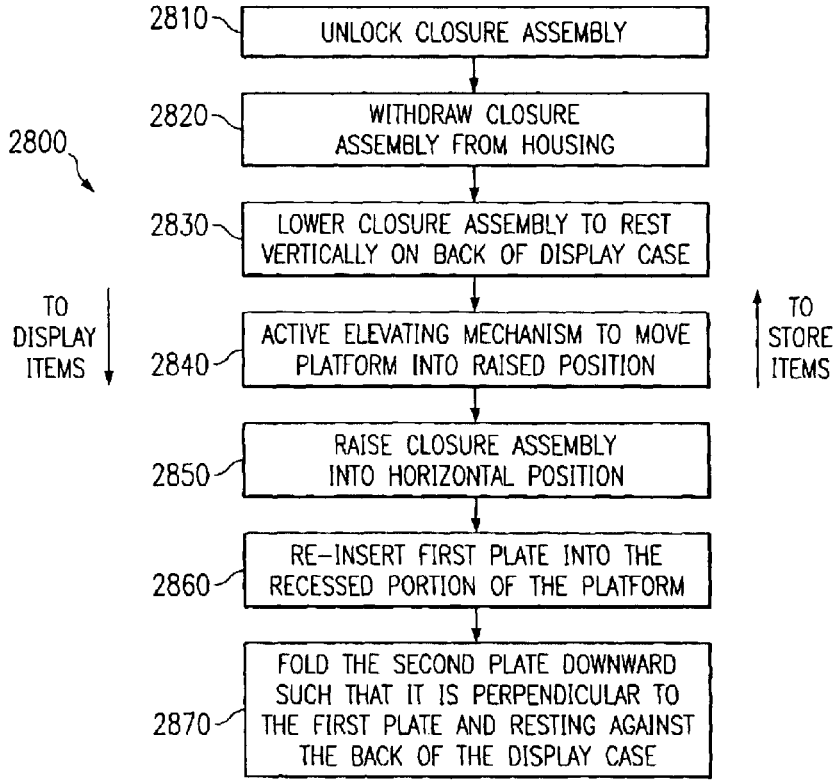
FIG. 28 is a flow chart diagram illustrating one method of operation for a display case security apparatus having a hinged closure assembly.

Referring now to FIG. 28, one method of operation 2800 for a display case security apparatus having a hinged closure assembly is shown. Starting with the platform in the lowered position and the closure assembly fully secured within the housing, the method of operation begins with the step of opening the locks holding the closure assembly in place, as noted in block 2810. The operator then grasps the back edge of closure assembly and, as indicated by block 2820, withdraws the assembly from the housing by sliding the assembly horizontally rearward. With the closure assembly fully withdrawn, the operator may proceed to block 2830 in which the assembly is gently lowered and allowed to swing downward about 90° to rest vertically against the back of the display case. Moving on to block 2840, the elevating mechanism may then be activated to move the platform into the raised position such that items offered for sale are disposed in the display section. With the platform in the raised position, a rearward facing recessed space within the platform is aligned on a horizontal plane with the closure slot of the housing. Next, in block 2850, the operator again grasps the edge of the closure assembly and rotates it up into a horizontal position. Note that the hinge in the closure assembly should preferably be constructed such that the rear plate may not rotate past the fully opened or flat position relative to the forward plate. As indicated in block 2860, the operator then re-inserts the forward plate into the closure slot and into the recessed space of the modified platform. With the forward plate re-inserted into the housing and the modified platform, the rear plate may be rotated downward about the hinge, as noted in block 2870, to be generally perpendicular to the first plate and resting vertically against the back of the display case. To store and secure the items offered for sale, each of the steps in the method of operation to display the items are simply reversed. It is also understood that several of these steps may be omitted, namely the lowering (block 2830) and raising (block 2850) of the closure assembly, and other steps may be added as needed.

Although several embodiments have been described in detail, it should be understood that various changes, substitutions and alterations can be made therein without departing from the spirit and scope of the invention as defined by the appended claims.

What is claimed is:

1. A display case security apparatus comprising:

a housing including a lower storage section and an upper display section disposed above the storage section, the storage section having an opaque exterior wall and the display section having an exterior wall which is at least partially transparent;

a platform disposed within the housing and including a generally horizontal portion for supporting articles to be displayed, the platform configured to define a rearward facing recessed space and further being selectively movable between a first position, wherein any articles supported on the platform are disposed in the display section of the housing, and a second position, wherein any articles supported on the platform are disposed in the storage section of the housing;

an elevating mechanism mounted within the housing and connected to the platform, the elevating mechanism being selectively moveable between an extended configuration and a retracted configuration, whereby the platform moves between the first position and the second position when the elevating mechanism moves between the extended configuration and the retracted configuration respectively;

a closure assembly having a first plate joined to a second plate by at least one hinge;

wherein the first plate of the closure assembly may be selectively inserted into the recessed space of the platform when the platform is in the first position; and wherein further both plates of the closure assembly may be selectively inserted between the display section and the storage section when the platform is in the second position, whereby the platform and any articles supported thereon are enclosed within the storage section of the housing.

2. The display case security apparatus of claim 1, wherein the first and second plate of the closure assembly are formed of sheets of aluminum alloy having a generally uniform thickness within the range from about ⅛ to about ¼ inch.

3. The display case security apparatus of claim 1, wherein the recessed space of the platform is a storage slot.

4. The display case security apparatus of claim 1, wherein the at least one hinge of the closure assembly sweeps angle of about 0° to about 180°.

5. The display case security apparatus of claim 1, wherein the at least one hinge of the closure assembly is a piano hinge.

6. The display case security apparatus of claim 1, wherein the width of the first plate is about 15% to about 75% of the total width of the closure assembly.

7. The display case security apparatus of claim 1, wherein the width of the first plate is about 30% to about 50% of the total width of the closure assembly.

8. The display case security apparatus of claim 1, wherein the first and second plate of the closure assembly are substantially the same size and shape.

9. A display case security apparatus comprising:

a housing including a lower storage section and an upper display section disposed above the storage section, the storage section having an opaque exterior wall and the display section having an exterior wall which is at least partially transparent;

a platform disposed within the housing and including a generally horizontal portion for supporting articles to be displayed, the platform configured to define a rearward facing recessed space and further being selectively movable between a first position, wherein any articles supported on the platform are disposed in the display section of the housing, and a second position, wherein any articles supported on the platform are disposed in the storage section of the housing;

an elevating mechanism mounted within the housing and connected to the platform, the elevating mechanism being selectively moveable between an extended configuration and a retracted configuration, whereby the platform moves between the first position and the second position when the elevating mechanism moves between the extended configuration and the retracted configuration respectively;

a secondary storage section disposed below and isolated from the storage section and accessible from the exterior of the housing regardless of the position of the platform;

at least one storage drawer slidably mounted in the secondary storage section and accessible form the rear side of the housing;

a closure assembly having a first plate joined to a second plate by at least one hinge;

wherein both plates of the closure assembly may be selectively inserted between the display section and the storage section when the platform is in the second position, whereby the platform and any articles supported thereon are enclosed within the storage section of the housing; and wherein further the first plate of the closure assembly may be selectively inserted into the recessed space of the platform when the platform is in the first position such that the second plate of the closure assembly does not block access to the at least one storage drawer.

10. The display case security apparatus of claim 9, wherein when both plates of the closure assembly rest against the back of the housing, the second plate blocks access to the at least one drawer.

11. A method of operating a display case security apparatus comprising a housing including a lower storage section and an upper display section disposed adjacent the storage section, a platform disposed within the housing, the platform configured to define a rearward facing recessed space and further being selectively movable between a first position, wherein any articles supported on the platform are disposed in the display section of the housing, and a second position, wherein any articles supported on the platform are disposed in the storage section of the housing, an elevating mechanism mounted within the housing and connected to the platform, the elevating mechanism being selectively moveable between an extended configuration and a retracted configuration, whereby the platform moves between the first position and the second position when the elevating mechanism moves between the extended configuration and the retracted configuration respectively, a closure assembly having a first plate joined to a second plate by at least one hinge, the first plate of the closure assembly being selectively insertable into the recessed space of the platform when the platform is in the first position, and both plates of the closure assembly being selectively insertable between the display section and the storage section when the platform is in the second position, the method of operation, starting from the secured state in which the platform is in the second position and both plates of the closure assembly are fully inserted, comprising the steps of:

a) sliding the closure assembly horizontally rearward until both plates are completely withdrawn from the housing;

b) activating the elevating mechanism to raise the platform into the first position; and c) re-inserting the first plate of the closure assembly through the closure slot of the housing and into the recessed space of the platform.

12. A method in accordance with claim 11, wherein between steps a) and b) the method further comprises the step of lowering the closure assembly downward to rest vertically against the back of the housing.

13. A method in accordance with claim 12, wherein between steps b) and c) the method further comprises the step of lifting the closure assembly upward into a horizontal position.

14. A method in accordance with claim 11, wherein following step c) the method further comprises the step of folding the second plate of the closure assembly downward to be generally perpendicular to the first plate and resting vertically against the back of the housing.

15. A method in accordance with claim 11, wherein after folding the second plate downward the method further comprises the following steps:

d) sliding the first plate horizontally reward and out of the housing;

e) activating the elevating mechanism to lower the platform into the second position; and f) sliding the closure assembly horizontally forward until both plates are completely inserted into the housing.

16. A method in accordance with claim 15, wherein following step f) the method further comprises the step of locking the closure assembly within the housing.

* * * * *